US007210754B2

(12) United States Patent
Tatsumi

(10) Patent No.: US 7,210,754 B2
(45) Date of Patent: May 1, 2007

(54) IMAGE RECORDING APPARATUS AND METHOD

(75) Inventor: Setsuji Tatsumi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 227 days.

(21) Appl. No.: 10/950,418

(22) Filed: Sep. 28, 2004

(65) Prior Publication Data

US 2005/0099441 A1 May 12, 2005

(30) Foreign Application Priority Data

Sep. 29, 2003 (JP) ..... 2003-338829

(51) Int. Cl.
*B41J 29/38* (2006.01)

(52) U.S. Cl. ..... 347/6; 347/13

(58) Field of Classification Search ..... 347/6
See application file for complete search history.

(56) References Cited

U.S. PATENT DOCUMENTS

2004/0046832 A1* 3/2004 Kuwahara ..... 347/43

FOREIGN PATENT DOCUMENTS

JP 10-157135 A 6/1998
JP 2000-326497 A 11/2000
WO WO-03-045696 A1 6/2003

* cited by examiner

*Primary Examiner*—Stephen Meier
*Assistant Examiner*—Jannelle M. Lebron
(74) *Attorney, Agent, or Firm*—Birch, Stewart, Kolasch & Birch, LLP

(57) ABSTRACT

The image recording apparatus comprises: a full-line recording head in which a plurality of image-recording elements are arrayed across a length corresponding to an entire width of a printing medium; a conveyance device which conveys at least one of the recoding head and the printing medium in a direction substantially orthogonal to a width direction of the printing medium so as to move the recording head and the printing medium relatively to each other in a relative conveyance direction; and a recording control device which performs recording control so that when recording is carried out with respect to a solid area of a recorded image with a substantially uniform density, diameter of dots in the solid area recorded on the printing medium with the image-recording elements is made greater than an array pitch of the image-recording elements projected so as to be aligned in a main scanning direction substantially orthogonal to the relative conveyance direction.

8 Claims, 11 Drawing Sheets

IMAGE RECORDING APPARATUS AND METHOD

BACKGROUND OF THE INVENTION

1. Field of the Invention

The present invention relates an image recording apparatus and method, and more particularly to an image recording technique suitable for concealing print nonuniformity (streak error) in the form of streaks in the sub-scanning direction in an inkjet recording apparatus equipped with a full-line recording head having a row of nozzles that corresponds to the entire recordable width along the main scanning direction.

2. Description of the Related Art

In an inkjet recording apparatus provided with a line head with a row of nozzles that covers the entire width of the recording paper, recording is normally carried out with just a single nozzle for the same position in the main scanning direction (nozzle array direction), so that variation in the dot size and position due to the variable performance of a nozzle appears as a streak in the sub-scanning direction (paper conveyance direction).

Japanese Patent Application Publication No. 10-157135 discloses that streak error is inhibited with a configuration in which a plurality of nozzles are disposed in the same position in the main scanning direction, the nozzle to be used for recording is selected from the plurality of nozzles to eject droplets, and droplet ejection from the same nozzle in the sub-scanning direction is not continued for a large number of ejections. However, this configuration requires that two or more rows of nozzles be disposed in the sub-scanning direction, and there is a drawback in that the number of nozzles increases.

Japanese Patent Application Publication No. 2000-326497 discloses a method whereby streaks are rendered unnoticeable by randomly or periodically varying dot sizes produced by the ejection of droplets from the same nozzle. However, in this method, the dot sizes must be changed when ejecting droplets, and varying the dot sizes increases the complexity of the drive control (control for each nozzle) for the inkjet head. Also proposed in Japanese Patent Application Publication No. 2000-326497 is the concept of varying the dot sizes, but no specific mention is made as to the manner in which the variation is to occur and under what conditions, and there is no disclosure as to the relationship between the dot size, nozzle spacing (nozzle pitch) in the main scanning direction, droplet ejection density in the sub-scanning direction, and various other conditions.

As the demand for higher resolution and quality has increase in recent years, development of high density recording is being advanced whereby the nozzle pitch is decreased and the droplet ejection spacing is reduced in the sub-scanning direction, but when images are recorded with such high density, the degree of freedom in dot arrangement is increased while the effect of dots produced by the droplet ejection from nearby nozzles also increases. Japanese Patent Application Publication No. 2000-326497 does not provide consideration for this point, and it is difficult to refer to this method as an optimal control method for inhibiting nonuniformity.

SUMMARY OF THE INVENTION

The present invention is contrived in view of such circumstances, and an object thereof is to provide an image recording apparatus and image recording method that give consideration to conditions that are effective for inhibiting streaks, and that form an adequate image in which nonuniformity is not noticeable by means of a relatively simple method.

In order to attain the above-described object, the present invention is directed to an image recording apparatus, comprising: a full-line recording head in which a plurality of image-recording elements are arrayed across a length corresponding to an entire width of a printing medium; a conveyance device which conveys at least one of the recoding head and the printing medium in a direction substantially orthogonal to a width direction of the printing medium so as to move the recording head and the printing medium relatively to each other in a relative conveyance direction; and a recording control device which performs recording control so that when recording is carried out with respect to a solid or gradation area of a recorded image with a substantially uniform or gradually changing density, diameter of dots in the solid or gradation area recorded on the printing medium with the image-recording elements is made greater than an array pitch of the image-recording elements projected so as to be aligned in a main scanning direction substantially orthogonal to the relative conveyance direction.

In accordance with the present invention, an image is formed on a printing medium by the operation of image-recording elements in the a full-line recording head having a row of image-recording elements that covers the entire printable width in the main scanning direction while the printing medium is moved in a relative fashion in the sub-scanning direction with respect to the recording head. A solid area that is printed with a substantially uniform density or a gradation image area formed with a variable density is such that nonuniformity tends to be easily observed, so when images are printed in these areas, the dot diameter is increased with respect to the array pitch (a distance between the adjacent image recoding elements) of the image-recording elements projected to the projection surface along the main scanning direction, and, as a result, the dot diameter, dot arrangement, and other factors are controlled so that the recording density is reduced.

Dots formed by neighboring image-recording elements thereby partially overlap each other, and a portion of the surface area recorded by certain image-recording elements can be covered by dots from neighboring image-recording elements. Therefore, streaks in the sub-scanning direction due to the effect of dots from neighboring image-recording elements become difficult to observe even when there is variability in the dot size and position.

In the present specification, the term "printing" expresses the concept of not only the formation of characters, but also the formation of images with a broad meaning that includes characters.

A "full-line recording head" is normally disposed along the direction orthogonal to the relative feed direction (direction of relative movement) of the printing medium, but also possible is an aspect in which the recording head is disposed along the diagonal direction given a predetermined angle with respect to the direction orthogonal to the direction of relative movement. The array form of the image-recording elements in the recording head is not limited to a single row array in the form of a line, but a matrix array composed of a plurality of rows is also possible. Furthermore, also possible is an aspect in which a plurality of short-length recording head units having a row of image-recording elements that do not have lengths that correspond to the entire width of the printing medium are combined, and the image-recording element rows are configured so as to correspond to the entire width of the printing medium, with these units acting as a whole.

The "printing medium" is a medium (an object that may be referred to as an image formation medium, record medium, recording medium, image receiving medium, or the like) that receives the recording of the recording head, and includes continuous paper, cut paper, seal paper, OHP sheets, and other resin sheets, as well as film, cloth, printed substrates on which wiring patterns are formed with an inkjet recording apparatus, and various other media without regard to materials or shapes.

The term "conveyance device" includes an aspect in which the printing medium is conveyed with respect to a stationary (fixed) recording head, an aspect in which the recording head is moved with respect to a stationary printing medium, or an aspect in which both the recording head and the printing medium are moved.

Preferably, the diameter of the dots, arrangement of the dots, and the array pitch of the image-recording elements are set so as to satisfy the following formula: $\{Ei+\times(Ei+-Si+)\}^{1/2}<\alpha\times(Np/2)\times Ds$, where: Np is the array pitch of the image-recording elements in the main scanning direction, Ds is a predetermined distance in a sub-scanning direction that is orthogonal to the main scanning direction on the printing medium, Ei+ is a total surface area of a portion contained in a rectangular area of $(Np/2)\times Ds$ on a side of an (i+1)-th image-recording element, of a surface area covered with dots formed by an i-th image-recording element under ideal conditions, Si+ is a total surface area of a portion contained in the rectangular area of $(Np/2)\times Ds$ on the side of the (i+1)-th image-recording element, of a surface area covered with dots formed by an image-recording element other than the i-th element under ideal conditions, and $\alpha$ is a predetermined constant.

"Ideal conditions" as used herein signifies ideal conditions in which there is no variability in the dot diameter and position, and refers to conditions that are reasonably envisioned based on the design under the assumption that variability does not exist.

Ei+ indicates the extent to which a streak caused by the i-th image-recording element is accentuated. The extent to which nonuniformity caused by the i-th image-recording element is observed in an area along the paper conveyance direction (direction of relative movement) in the vicinity of the i-th image-recording element is the amount that the recording surface area occupied by dots formed by the i-th image-recording element changes due to a recording defect in the i-th image-recording element. The amount of change in the surface area is substantially proportional to the surface area of the dots that were originally to be recorded by the i-th image-recording element, so that Ei+ as related to the above definition can be thought of as the amount that represents the extent to which the i-th image-recording element accentuates nonuniformity in the vicinity of the rectangular area $(Np/2)\times Ds$ (refer to FIGS. 9A and 9B).

FIGS. 9A and 9B show examples, in an inkjet recording apparatus in which nozzles for discharging ink droplets are used as image-recording elements, the positions where droplets ejected by the i-th nozzle are deposited are shifted slightly leftward in the drawings from the original (normal) droplet deposition positions. The hatched portions 110 in FIGS. 9A and 9B shows the surface area in which droplet deposition is changed by a nozzle discharge defect (in this case, shift of the droplet deposition position). As shown in FIGS. 9A and 9B, the amount of change in the surface area shown in FIG. 9A is greater than the change in surface area shown in FIG. 9B, so that the nonuniformity in FIG. 9A is more visible.

Si+ shows the extent to which nonuniformity caused by the i-th image-recording element is concealed by dots formed by image-recording elements in the area other than the i-th element. More specifically, variation in the surface area of dots caused by recording defects in the i-th image-recording element can be reduced if the surface area of the dots produced by other image-recording elements is greater in the same area, even if the surface area of the printed dots formed by the i-th image-recording element varies due to the recording defect in the i-th image-recording element. The effect of reducing nonuniformity through Si+ also depends on the magnitude of Ei+. This is apparent from the fact that if the position of a dot recorded by the i-th image-recording element and the position of a dot recorded by image-recording elements other than the i-th element come closer together, moreover the overlapping area increases, then nonuniformity can be concealed more effectively (refer to FIG. 10).

In FIG. 10, the range of the downward-right-hatched area 112 represents the surface area in which droplet deposition is changed by a discharge defect of the nozzle (in this case, a shift in the droplet deposition position), and the range of the upward-right-hatched area 114 represents a droplet deposition surface area produced by a nozzle other than the i-th nozzle (e.g., the (i+1)-th nozzle). The overlapping areas of both provide a weak contribution to the accentuation of nonuniformity in particular.

Therefore, when "Ei+×Si+" is considered to be the amount by which nonuniformity is concealed, $Ei+^2Ei+\times Si+ = Ei+\times(Ei+-Si+)$ can be thought of as the amount that expresses the strength of the nonuniformity. This is normalized by the target surface area $(Np/2)\times Ds$, and the conditions for the dot diameters and dot positions of the i-th image-recording element and image-recording elements other than the i-th element and nozzle array pitch are determined so as to satisfy the relationship $\{Ei+\times(Ei+-Si+)\}^{1/2}<\alpha\times(Np/2)\times Ds$. The constant $\alpha$ is a value indicating the reference at which nonuniformity is not visible. In accordance with experimentation, it is preferable that $\alpha$ is preferably 0.4 and Ds is 1 mm or greater and 10 mm or less.

The present invention is particularly advantageous when applied to a solid area which has densities up to an intermediate density and in which nonuniformity is easily visible, or to a gradual gradation area.

A gradual gradation refers to a gradation in which the density change is 0.2 or less per 5 mm per side on a printout. The term "solid" refers a printing in which the surface area of the solid area is equal to or greater than a rectangle measuring 5 mm on a side on the printout. This corresponds to a surface created by computer graphics (CG), or the solid area of an image in which the noise level is extremely low, such as an image of the sky or other background in an actual image, for example.

In accordance with a more specific aspect of the present invention, the recording head is a high-density recording head in which the array pitch Np of the image-recording elements in the main scanning direction is not longer than 30 μm; and the solid portion is not smaller than a 5 mm square on the printing medium, or the density change is not more than 0.2 per a 5 mm square on the image recording medium in the gradation area.

The image recording apparatus according to an aspect of the present invention can be used as an inkjet recording apparatus. In other words, the image-recording elements comprise nozzles which discharge ink droplets; and the recording control device controls droplet ejection from the nozzles so as to make the diameter of the dots produced by the ink droplets ejected from the nozzles greater than the array pitch of the nozzles in the main scanning direction.

In the implementation of the present invention, the linear inkjet head in which the size of the dots is made equal to or greater than the array pitch of the nozzles is preferably a head with a matrix structure in which the nozzles are arrayed in the form of a matrix in order to prevent droplets from interfering with each other as a result of being ejected at substantially the same time.

The present invention also provides a method invention for achieving the above-stated object. More specifically, the present invention is directed to an image recording method, comprising: forming an image on a printing medium with a full-line recording head in which a plurality of image-recording elements are arrayed across a length corresponding to an entire width of the printing medium by at least one of the recoding head and the printing medium in a direction substantially orthogonal to a width direction of the printing medium so as to move the recording head and the printing medium relatively to each other in a relative conveyance direction; and performing recording control so that when recording is carried out with respect to a solid or gradation area of a recorded image with a substantially uniform or gradually changing density, diameter of dots in the solid or gradation area recorded on the printing medium with the image-recording elements is made greater than an array pitch of the image-recording elements projected so as to be aligned in a main scanning direction substantially orthogonal to the relative conveyance direction.

In accordance with the present invention, recording in a solid or gradation area in which nonuniformity is easily visible is controlled to ensure that the dot diameter is greater than the array pitch of the image-recording elements, so the occurrence of streak error in the sub-scanning direction is concealed by the effect of dots produced by recording from neighboring image-recording elements, even if variability occurs in the dot size and position due to variability in the image-recording elements.

In accordance with an aspect of the present invention, conditions that are effective for concealing streak error are disclosed with consideration for the share of recorded surface area contributed by image-recording elements that bring about (accentuate) streaks and the share of recording surface area contributed by peripheral image-recording elements that conceal such streak error, making it possible to provide a recording method in which nonuniformity is reduced in single-pass solid printing or gradation-image recording with a full-line recording head.

Furthermore, the present invention can be applied to high-density recording heads because of the use of an index that takes into consideration the relationship between the dot size and the array pitch of the image-recording elements.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
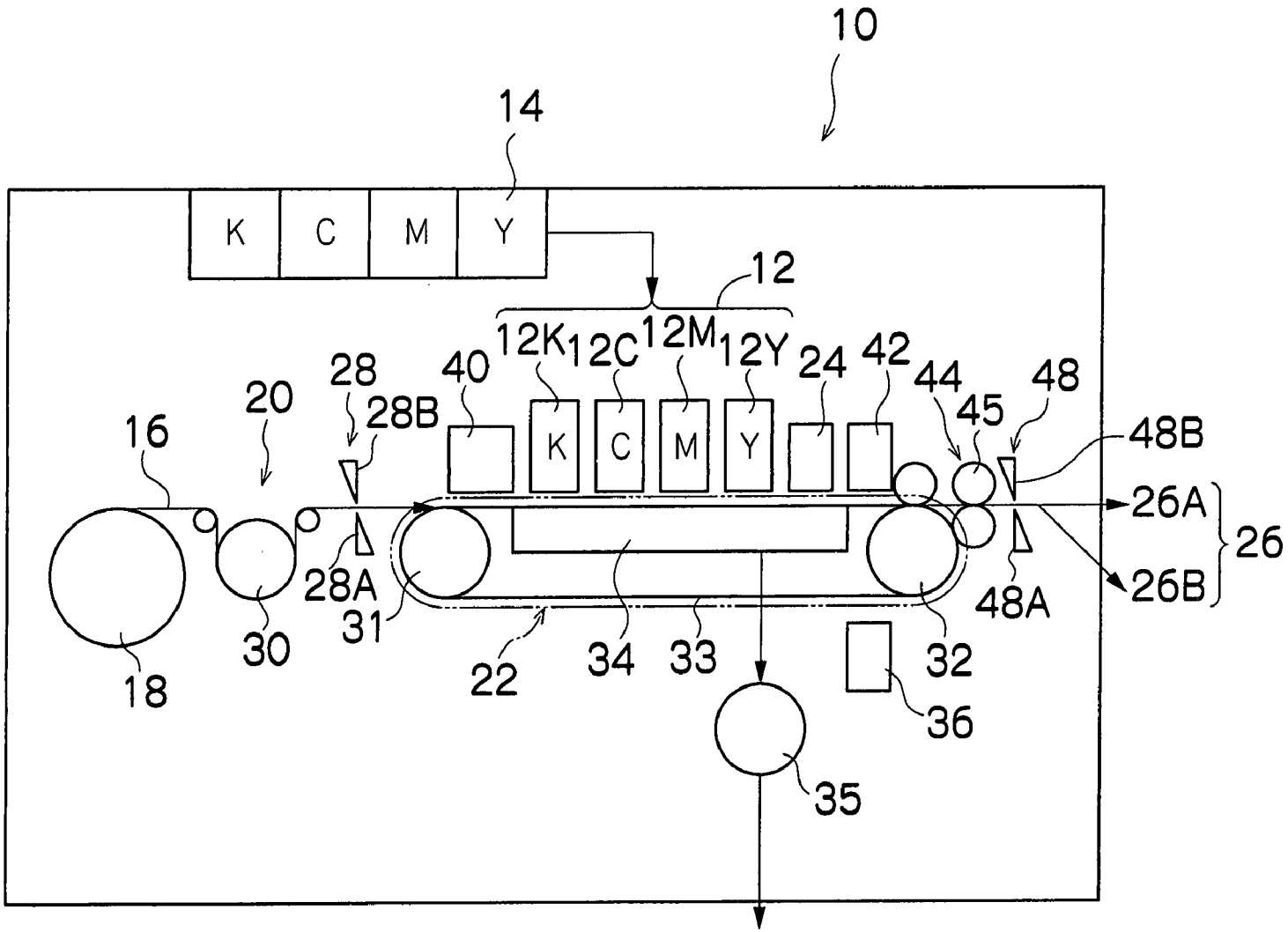
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
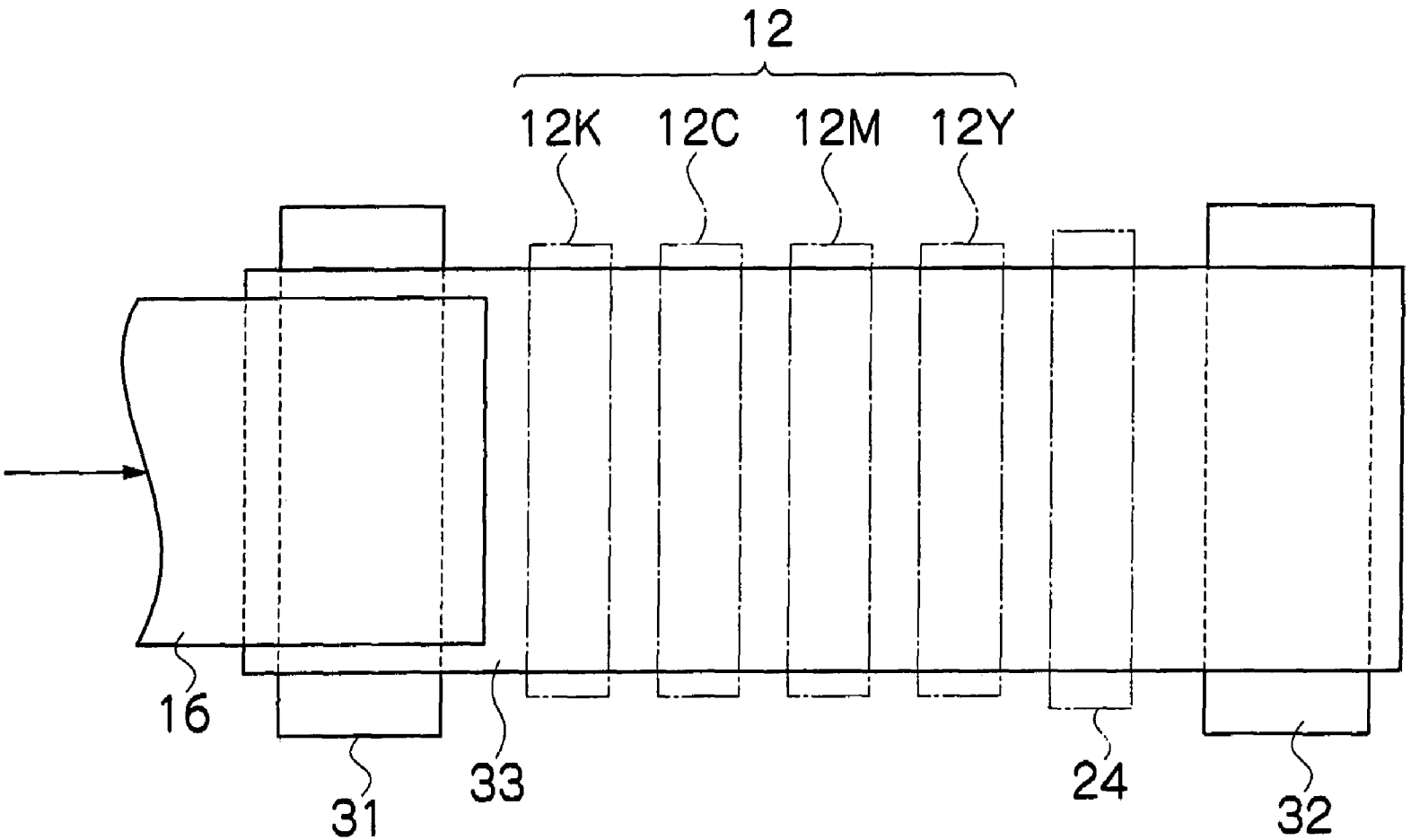
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern or the target image printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
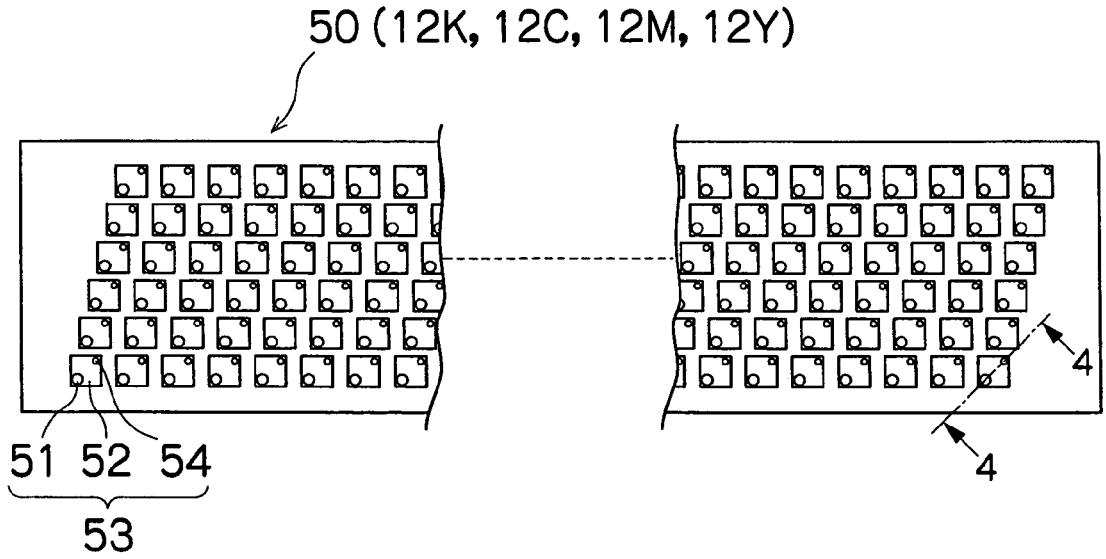
FIG. 3A is a perspective plan view showing an example of a configuration of a print head.
Figure 3B:
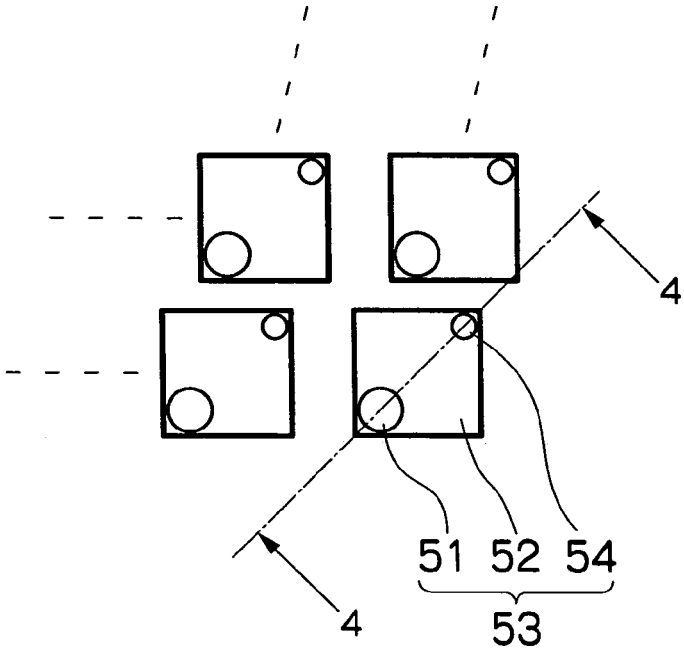
FIG. 3B is a partial enlarged view of FIG. 3A.
Figure 3C:
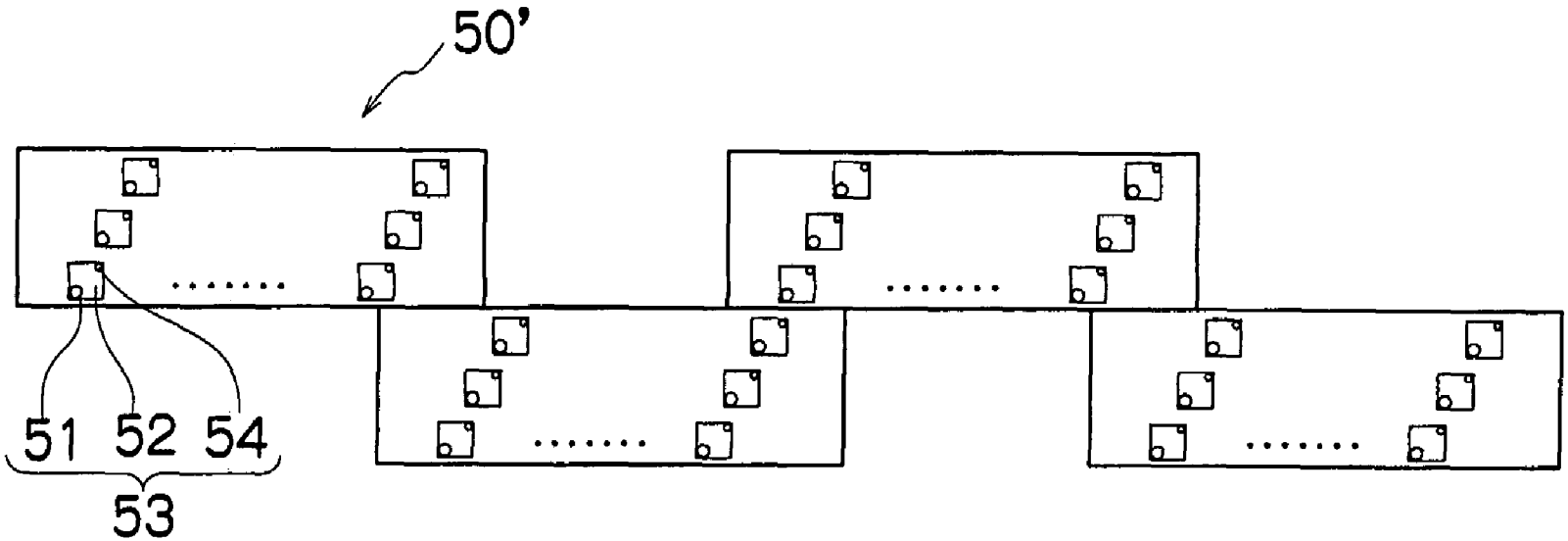
FIG. 3C is a perspective plan view showing another example of the configuration of the print head.
Figure 4:
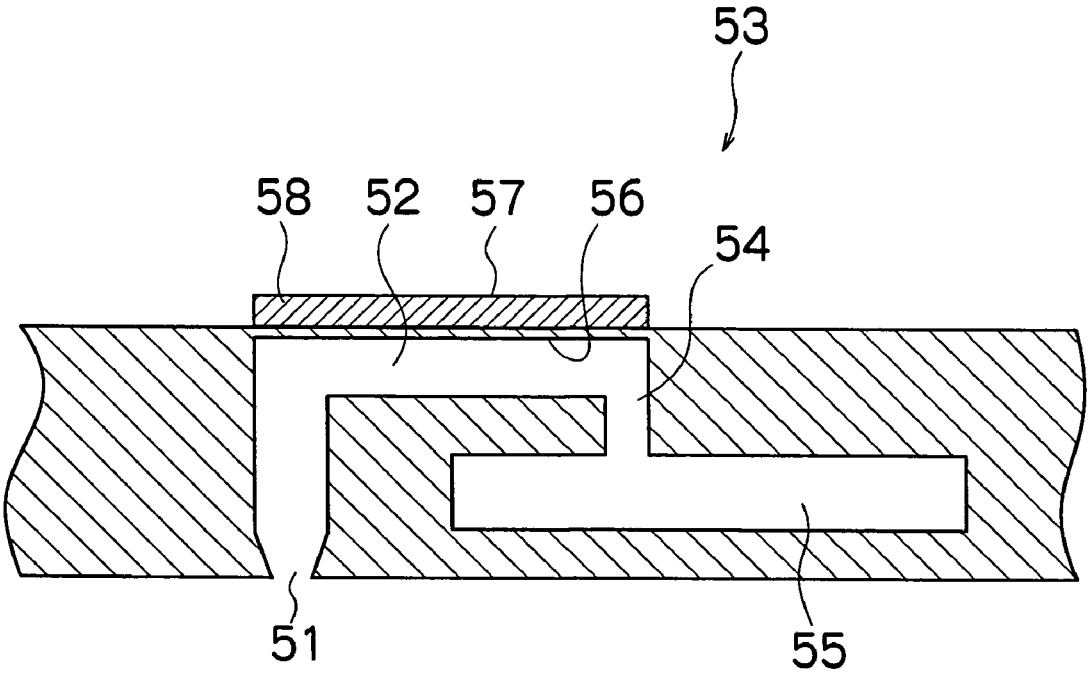
FIG. 4 is a cross-sectional view along a line 4—4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
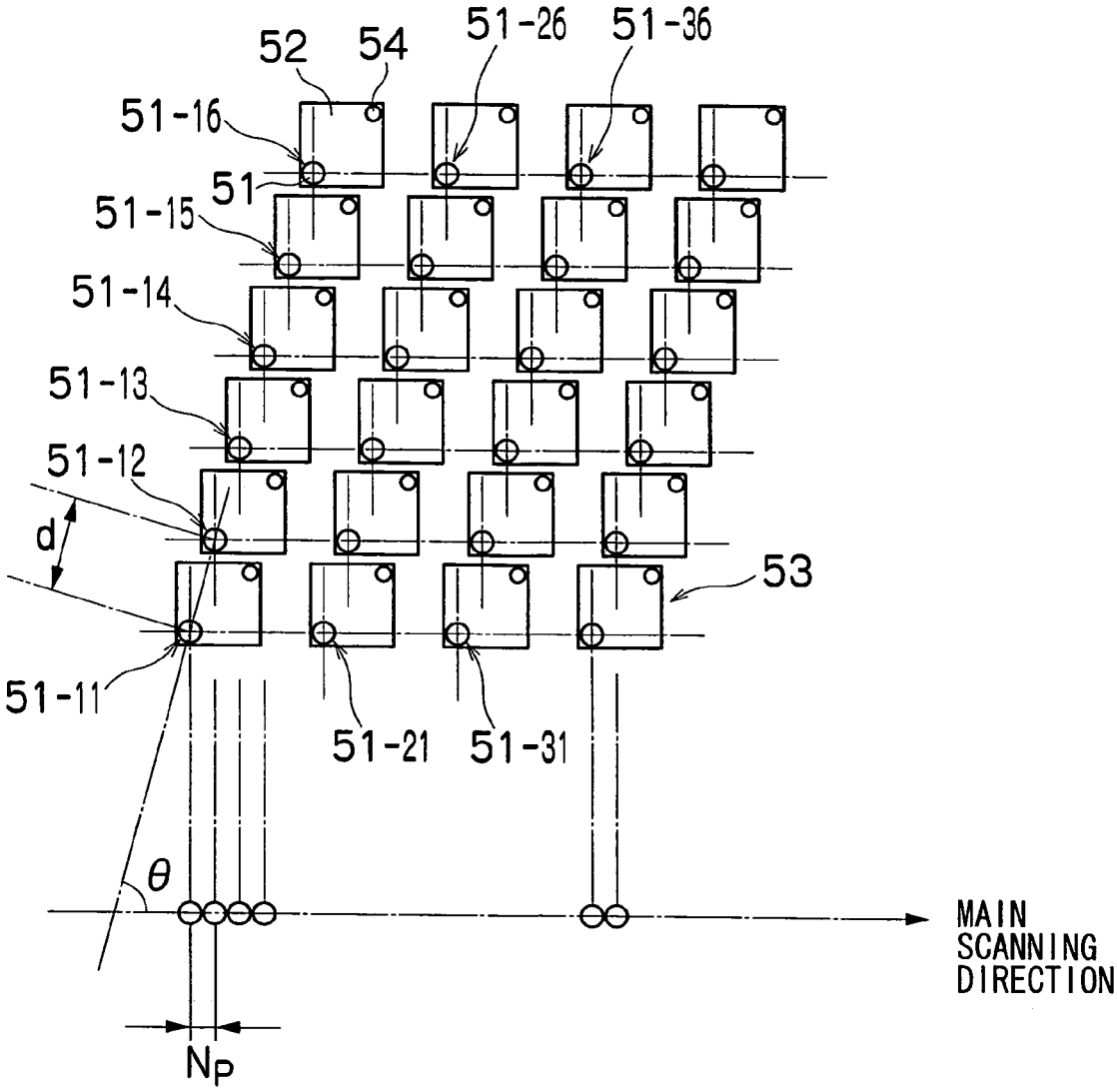
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch Np as projected in the main scanning direction is $d \times \cos\theta$.

Hence, the nozzles 51 can be regarded to be equivalent to those arranged at a fixed pitch Np on a straight line along the main scanning direction. Such configuration results in a nozzle structure in which the nozzle row projected in the main scanning direction has a high nozzle density of up to 2,400 nozzles per inch (npi). For convenience in description, the structure is described below as one in which the nozzles 51 are arranged at regular intervals (pitch Np) in a straight line along the lengthwise direction of the head 50, which is parallel with the main scanning direction.

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Figure 6:
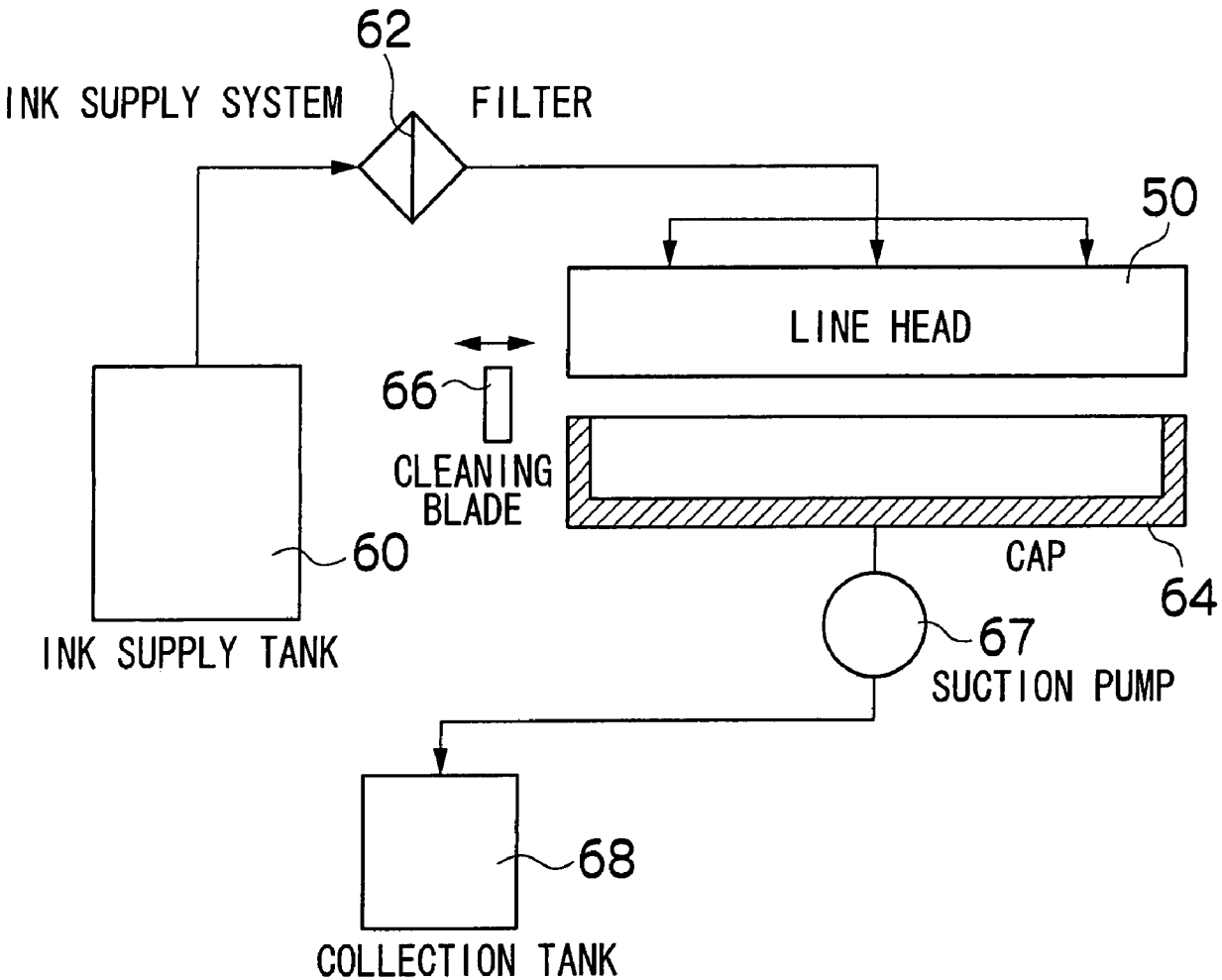
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 58 is operated. Before reaching such a state the actuator 58 is operated (in a viscosity range that allows discharge by the operation of the actuator), and the preliminary discharge is made toward the ink receptor to which the ink whose viscosity has increased in the vicinity of the nozzle is to be discharged. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 58 is operated. Also, when the ink viscosity inside the nozzle 51 has increased over a certain level, ink can no longer be discharged from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small.

Figure 7:
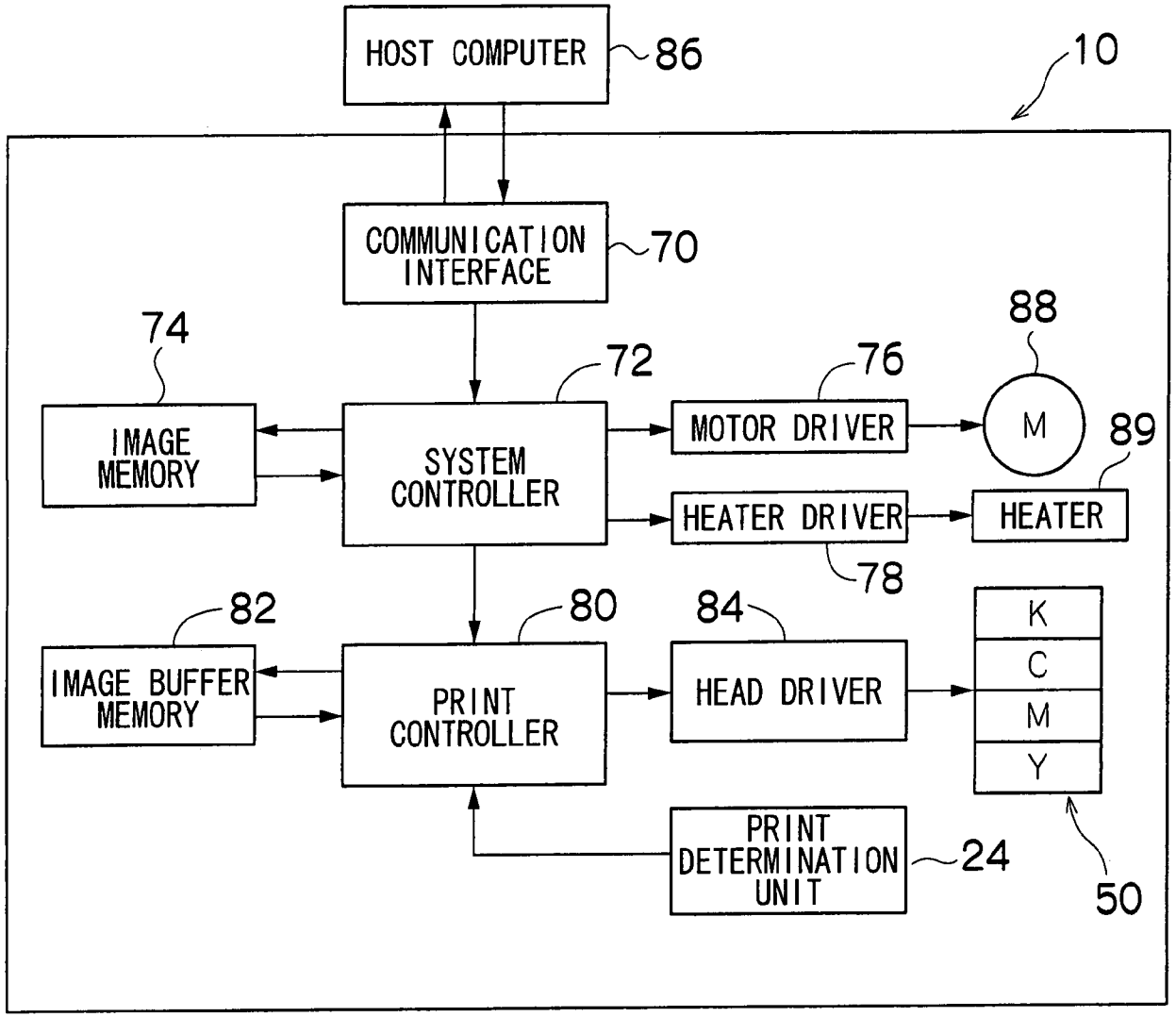
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby. The print controller 80 includes the recording control unit according to the embodiment of the present invention.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each color by a known random dithering algorithm or another technique in the print controller 80. In other words, the print controller 80 performs a processing for converting the inputted RGB image data to the dot data for the four colors of CMYK. The dot data generated by the print controller 80 is stored in the image buffer memory 82.

The head driver 84 acquires the dot data stored in the image buffer memory 82, generates drive control signals for the print head 50 according to the acquired dot data, and applies the drive control signals to the print head 50. The print head 50 ejects ink-droplets according to the drive control signals applied from the head driver 84. An image is formed on the recording paper 16 by controlling the ink-droplet ejection from the print head 50 in synchronization with the conveyance velocity of the recording paper 16.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The read start timing for the line sensor is determined from the distance between the line sensor and the nozzles and the conveyance velocity of the recording paper 16.

The print controller 80 makes various compensation with respect to the print head 50 as required on the basis of the information obtained from the print determination unit 24.

In the embodiment shown in FIG. 1, a configuration is adopted in which the print determination unit 24 is disposed on the printed surface side, the printed surface is illuminated by a cold-cathode tube or other light source (not shown) disposed in the vicinity of the line sensor, and the light reflected on the printed surface is read with the line sensor. However, also possible in the implementation of the present invention is a configuration in which a line sensor and a light source are set facing each other across the conveyance pathway of the recording paper 16, the light source emits light from the reverse side of the recording paper 16 (opposite of the surface on which ink-droplets are deposited); and the amount of light transmitted through the recording paper 16 is read with the line sensor.

Method of Droplet Ejection Control

Next, the method for controlling the droplet ejection in the inkjet recording apparatus 10 of the present embodiment is described.

Figure 8:
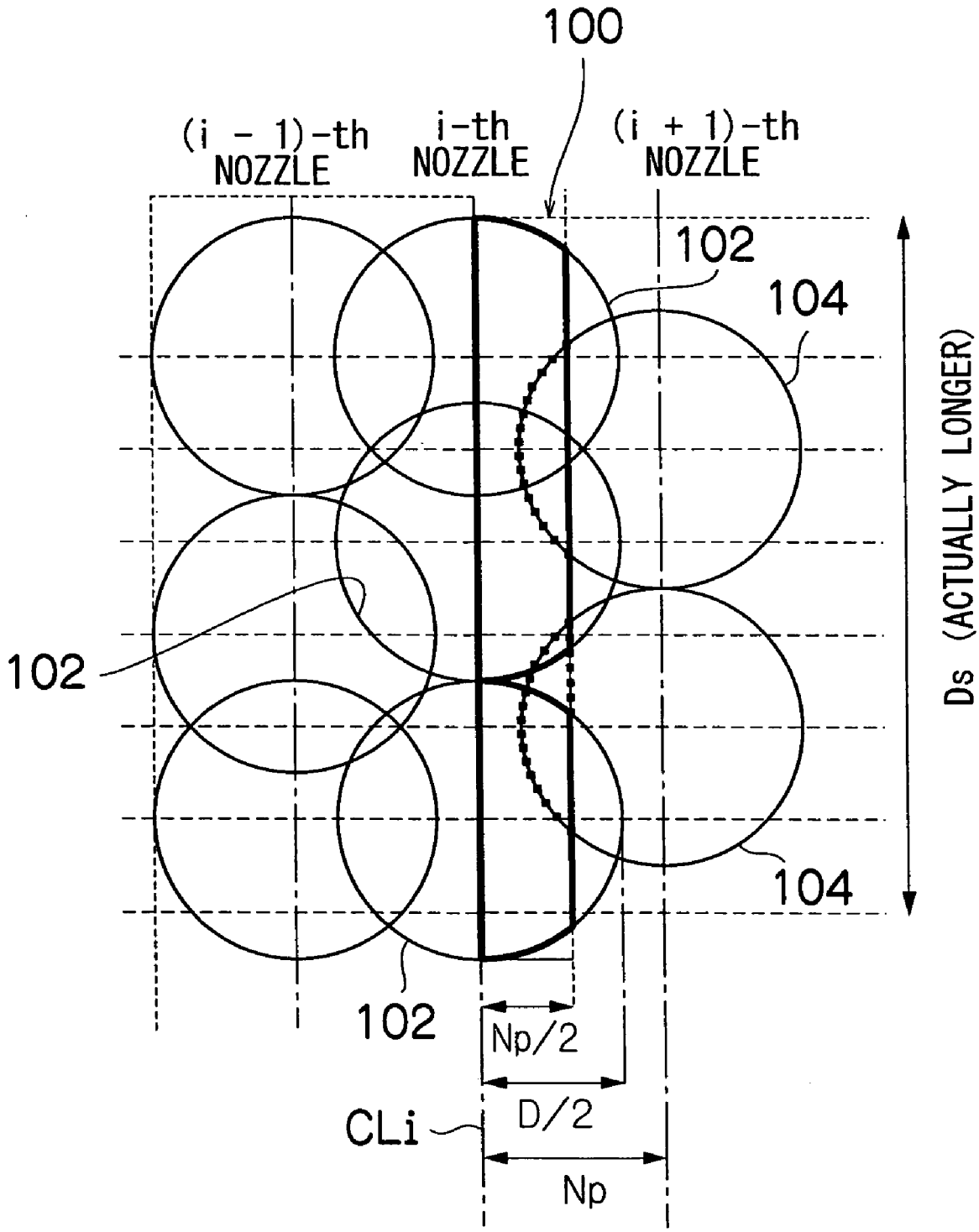
FIG. 8 is an enlarged view showing an example of a dot arrangement formed on recording paper.

FIG. 8 is an enlarged view showing an example of a dot arrangement formed on recording paper 16. In FIG. 8, the lateral direction is the main scanning direction (actual direction of the nozzle array), and the vertical direction is the sub-scanning direction (conveyance direction of the recording paper 16). As shown in FIG. 8, attention is given to the i-th nozzle of the nozzle row, and the relationship between the i-th nozzle and each of the (i−1)-th and (i+1)-th nozzles that are positioned on both sides of the i-th nozzle is considered. Here, Np is the distance (nozzle pitch) between the centers of the nozzles in the main scanning direction, and the nozzles record a solid or gradual gradation image including a dot of which radius D/2 is not less than Np/2.

First, consider the area contained in a rectangle 100 defined by the width of Np/2 from the center position of the i-th nozzle in the direction of the (i+1)-th nozzle (right-hand side in FIG. 8) and the length of a predetermined distance Ds in the sub-scanning direction. In FIG. 8, for convenience in description, a length of about slightly less than three dots in the sub-scanning direction is drawn as Ds, but the predetermined distance Ds established in actual practice is the minimum length that is visible as a nonuniformity, and may be a value of about 1 to 10 mm, for example.

In the rectangular area defined by (Np/2)×Ds, the value Ei+ indicating the extent to which nonuniformity caused by the i-th nozzle is accentuated is defined by the characteristics of dots 102 produced by droplets ejected from the i-th nozzle and the positions of the dots 102, and the value Si+ indicating the extent to which nonuniformity caused by the i-th nozzle is concealed is defined by the characteristics of dots 104 produced by droplets ejected from a peripheral nozzle other than the i-th nozzle (in this case, the (i+1)-th nozzle) and the positions of the dots 104.

Although not shown in FIG. 8, Ei− and Si− can be defined in the same manner for the direction from the i-th nozzle to the (i−1)-th nozzle (left-hand side in FIG. 8). However, the effects are left-right symmetric with respect to the center line CLi of the i-th nozzle, so that it is sufficient to limit discussion to the (i+1)-th nozzle side (positive side).

Ei+ is defined as the surface area of the portion sectioned off by the rectangle 100 expressed as (Np/2)×Ds and disposed on the (i+1)-th nozzle side as part of the surface area covered by the dots 102, 102, 102, . . . , that have been produced by droplets ejected from the i-th nozzle in an ideal condition (the condition in which there is no variability in the dot diameter and position). The surface area surrounded by the thick solid lines in FIG. 8 corresponds to Ei+.

Figure 9A:
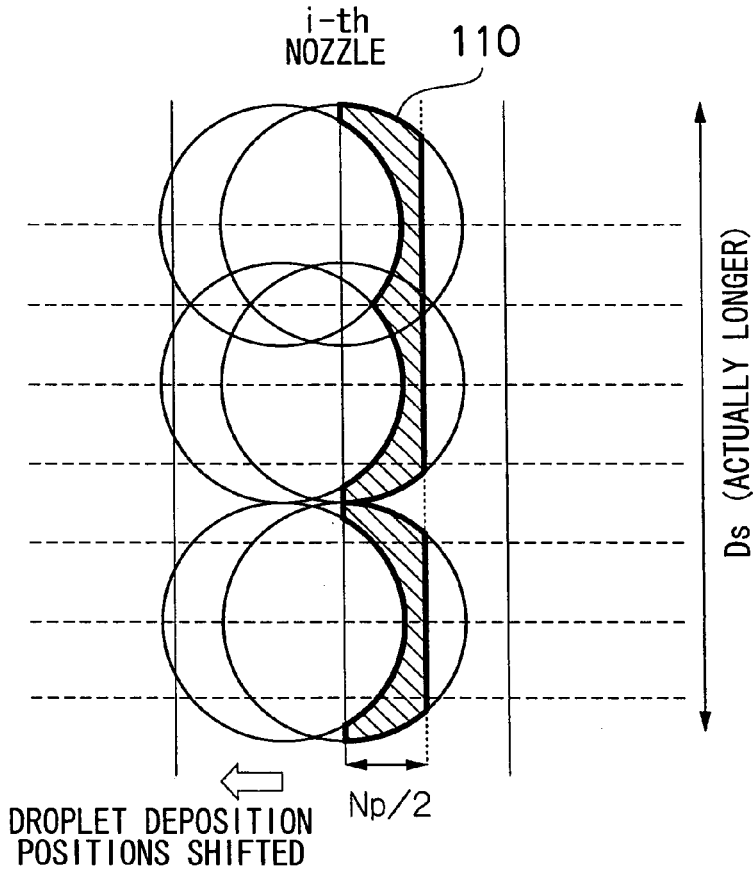
FIGS. 9A and 9B are diagrams used for describing the relationship between the visibility of nonuniformity and the amount of variation in the surface area of droplet deposition when the deposition positions of droplets shift due to a discharge defect of a nozzle.
Figure 9B:
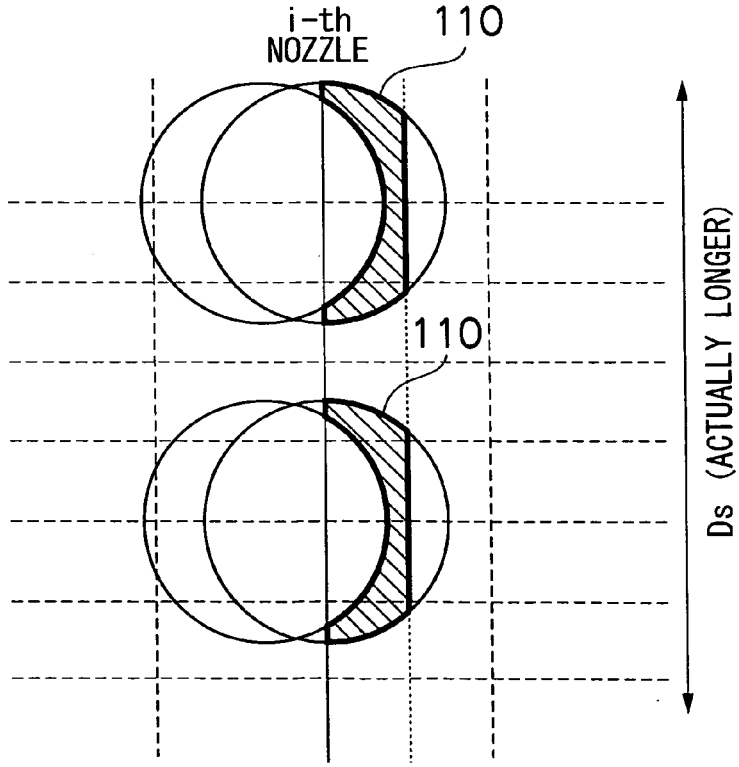

As described in FIGS. 9A and 9B, the extent to which nonuniformity caused by the i-th nozzle is observed depends on the amount that the surface area formed by dots within the area (Np/2)×Ds in the vicinity of the i-th nozzle in the paper conveyance direction produced by droplets ejected from the i-th nozzle changes due to a discharge defect in the i-th nozzle. The amount of change in the surface area is substantially proportional to the surface area of the dot that was originally to be produced by the i-th nozzle, so that the above defined Ei+ can be thought of as the amount which represents the extent to which the i-th nozzle accentuates nonuniformity in the Np/2 vicinity. Since the dot 102 is substantially circular, Ei+ is not limited solely to the range of the width Np/2 and may also represent the extent of accentuation of the nonuniformity created in the vicinity thereof.

Si+ is defined as the surface area of the portion sectioned off by the rectangle 100 expressed as (Np/2)×Ds and disposed on the (i+1)-th nozzle side as part of the surface area covered by the dots (the dots 104 in FIG. 8) produced by droplets ejected from nozzles other than the i-th nozzle in an ideal condition (the condition in which there is no variability in the dot diameter and position). The surface area surrounded by the thick dotted lines in FIG. 8 corresponds to Si+.

Figure 10:
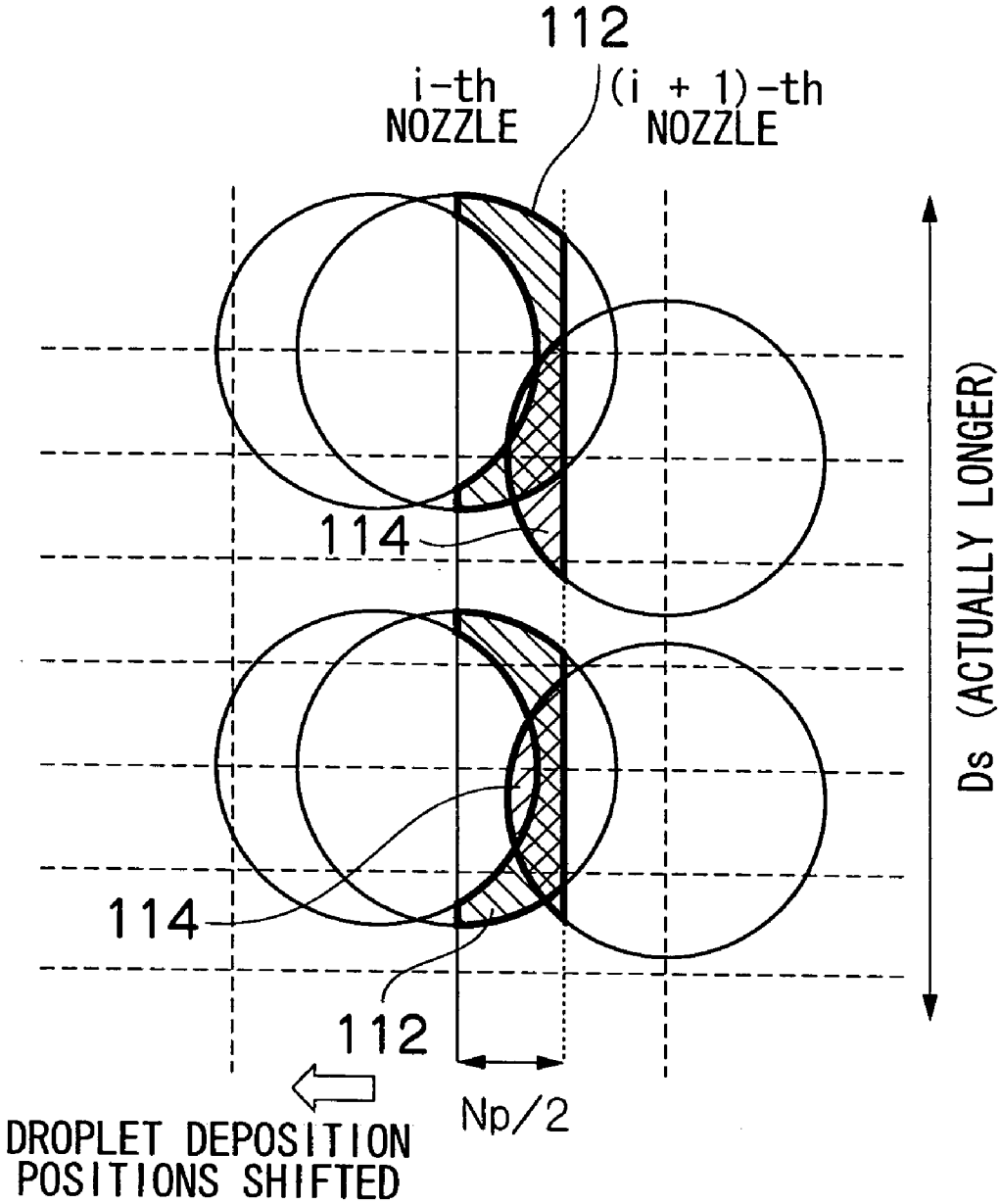
FIG. 10 is a diagram used for showing that nonuniformity is concealed by dots produced by droplets ejected from nozzles in the area around an incorrectly discharging nozzle.

As described in FIG. 10, Si+ can be thought as the amount that represents the extent to which nonuniformity caused by the i-th nozzle is concealed by dots produced by droplets ejected from peripheral nozzles other than the i-th nozzle.

The effect of reducing nonuniformity through Si+ depends on the magnitude of Ei+. Then, Ei+×Si+ is taken to be the amount by which nonuniformity is concealed, and the amount represented with the following Formula 1 expresses the strength of the nonuniformity:

$$Ei+^2-Ei+\times Si+=Ei+\times(Ei+-Si+). \quad (1)$$

By normalizing the Formula 1 with the entire surface area Ts=(Np/2)×Ds, the following Formula 2 is obtained:

$$\{Ei+\times(Ei+-Si+)\}^{1/2}<\alpha\times(Np/2)\times Ds, \quad (2)$$

where α is a predetermined constant. It is possible to form an adequate image in which nonuniformity is not noticeable by setting the dot size, dot position, and nozzle pitch so as to satisfy the relationship expressed in the Formula 2. It has been discovered through experimentation that α=0.4 is suitable.

The following Table 1 shows the results of the experiment.

TABLE 1

| Droplet Ejection Method | $\frac{Si+}{Ts}$ | $\frac{Ei+}{Ts}$ | $\frac{\sqrt{Ei+\times(Ei+-Si+)}}{Ts}$ | Extent of Nonuniformity |
|---|---|---|---|---|
| A | 0.981 | 0.577 | 0.629 | Highly Visible |
| B | 0.481 | 0.024 | 0.469 | Visible |
| C | 0.600 | 0.256 | 0.454 | Visible |
| D | 0.971 | 0.817 | 0.387 | Slightly Visible |
| E | 0.556 | 0.385 | 0.309 | Not Visible |
| F | 0.256 | 0 | 0.256 | Not Visible |

In this case, the visibility of nonuniformity in recording with a high-density line head in which the nozzle pitch is sufficiently small (30 μm or less, for example) is an issue, so in the present experiment, dots produced by droplets ejected from different nozzles in the same line were disposed so as to mix with other dots, a uniform solid image was printed, and the Si+ and Ei+ values shown in the table were obtained.

The dot diameter used was set to 40 μm or less so that the dot shape would not present any problems. The variability in the surface area of the dot for each nozzle at this time was about 30%, and the variability in the landing position of the droplets for each nozzle was maximally 15 μm.

As shown in Table 1, droplet ejection conditions (droplet ejection methods A to F) were varied so as to vary droplet arrangement; calculations were performed to determine for each condition, the normalized degree of nonuniformity concealment (Si+/Ts), the normalized degree of nonuniformity accentuation (Ei+/Ts), and the normalized evaluation value of the degree of nonuniformity strength ($\{Ei+\times(Ei+-Si+)\}^{1/2}/Ts$); and the visibility of the image printed with each droplet ejection method was evaluated.

In accordance with the experimental results, nonuniformity is noticeable when the evaluation value of the degree of nonuniformity strength is greater than 0.4, and nonuniformity decreases or becomes imperceptible when the value is less than 0.4. Therefore, α=0.4 is suitable as a constant that expresses the reference for determining the occurrence of nonuniformity. The value of $\alpha$ is not limited to 0.4 and may be appropriately changed to a value in the vicinity of 0.4, or a value that is less than 0.4 (0.3 or the like, for example) in accordance with an acceptable limit of nonuniformity visibility.

A dot arrangement that includes dithering is controlled so as to satisfy the above-described Formula 2. For example, the dot size is made larger and the droplet ejection density is made smaller with respect to the nozzle pitch for the solid area in which nonuniformity is easily visible up to an intermediate density. The droplet ejections conditions that satisfy the Formula 2 are exemplified in the following Table 2.

TABLE 2

| Density of Nozzle Array (Nozzle Pitch) | Dot Size in Diameter | Droplet Deposition Pitch in Sub-Scanning Direction |
|---|---|---|
| 1200 npi | 40 μm | 60 μm at least |
| 1800 npi | 30 μm | 40 μm at least |
| 2400 npi | 20 μm | 33 μm at least |
| 2400 npi | 25 μm | Arbitrary |

In accordance with the conditions shown in the Table 2, Ei+ can be reduced while Si+ can be simultaneously increased. When the dot size is sufficiently increased in comparison with the nozzle pitch Np, the Formula 2 is satisfied regardless of the droplet ejection density in the sub-scanning direction.

Droplet ejection control may be carried out over the entire image area so as to satisfy the Formula 2, but there are cases in which this approach invites deterioration of the image structure at the edges or other locations in which nonuniformity is not a problem, so that a solid area of 5 mm square or greater and in which nonuniformity is easily visible, or a gradation area in which the density change is 0.2 or less in a 5 mm square is determined in advance, and droplet ejection control is conducted so as to satisfy the Formula 2 in that area. The determination method may be a known method, although it is also possible, for example, to perform the determination by considering an image that measures about a 5 mm square on a print centered around the target pixel that has not yet been subjected to dithering, and to determine the average value of the image area as well as the minimum and maximum values of dispersion in a plurality of directions.

This droplet ejection control needs to be carried out solely for inks in which the visibility of nonuniformity is high, so that the droplet ejection control is dispensable for yellow ink.

An inkjet recording apparatus was described as an example of an image recording apparatus in the above embodiment, but the range of applicability of the present invention is not limited thereby. Other than inkjet methods, the present invention may also be applied to thermal transfer recording apparatuses with a line head, LED electrophotographic printers, silver halide photographic printers with an LED line exposure head, and other types of image recording apparatuses.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a full-line recording head in which a plurality of image-recording elements are arrayed across a length corresponding to an entire width of a printing medium;

a conveyance device which conveys at least one of the recoding head and the printing medium in a direction substantially orthogonal to a width direction of the printing medium so as to move the recording head and the printing medium relatively to each other in a relative conveyance direction; and a recording control device which performs recording control so that when recording is carried out with respect to a solid area of a recorded image with a substantially uniform density, diameter of dots in the solid area recorded on the printing medium with the image-recording elements is made greater than an array pitch of the image-recording elements projected so as to be aligned in a main scanning direction substantially orthogonal to the relative conveyance direction, wherein the diameter of the dots, arrangement of the dots, and the array pitch of the image-recording elements are set so as to satisfy the following formula:

$$\{Ei+\times(Ei+-Si+)\}^{1/2}<\alpha\times(Np/2)\times Ds,$$

where:

Np is the array pitch of the image-recording elements in the main scanning direction, Ds is a predetermined distance in a sub-scanning direction that is orthogonal to the main scanning direction on the printing medium, Ei+ is a total surface area of a portion contained in a rectangular area of (Np/2)×Ds on a side of an (i+1)-th image-recording element, of a surface area covered with dots formed by an i-th image-recording element under ideal conditions, Si+ is a total surface area of a portion contained in the rectangular area of (Np/2)×Ds on the side of the (i+1)-th image-recording element, of a surface area covered with dots formed by an image-recording element other than the i-th element under ideal conditions, and $\alpha$ is a predetermined constant.

2. The image recording apparatus as defined in claim 1, wherein the predetermined constant $\alpha$ is 0.4, and Ds is not shorter than 1 mm and not longer than 10 mm.

3. The image recording apparatus as defined in claim 1, wherein:

the recording head is a high-density recording head in which the array pitch Np of the image-recording elements in the main scanning direction is not longer than 30 μm; and the solid portion is not smaller than a 5 mm square on the printing medium.

4. The image recording apparatus as defined in claim 1, wherein:

the image-recording elements comprise nozzles which discharge ink droplets; and the recording control device controls droplet ejection from the nozzles so as to make the diameter of the dots produced by the ink droplets ejected from the nozzles greater than the array pitch of the nozzles in the main scanning direction.

5. An image recording method, comprising:

forming an image on a printing medium with a full-line recording head in which a plurality of image-recording elements are arrayed across a length corresponding to an entire width of the printing medium by at least one of the recoding head and the printing medium in a direction substantially orthogonal to a width direction of the printing medium so as to move the recording head and the printing medium relatively to each other in a relative conveyance direction; and performing recording control so that when recording is carried out with respect to a solid area of a recorded image with a substantially uniform density, diameter of dots in the solid area recorded on the printing medium with the image-recording elements is made greater than an array pitch of the image-recording elements projected so as to be aligned in a main scanning direction substantially orthogonal to the relative conveyance direction, wherein the diameter of the dots, arrangement of the dots, and the array pitch of the image-recording elements are set so as to satisfy the following formula:

$$\{Ei+\times(Ei+-Si+)\}^{1/2}<\alpha\times(Np/2)\times Ds,$$

where:

Np is the array pitch of the image-recording elements in the main scanning direction, Ds is a predetermined distance in a sub-scanning direction that is orthogonal to the main scanning direction on the printing medium, Ei+ is a total surface area of a portion contained in a rectangular area of (Np/2)×Ds on a side of an (i+1)-th image-recording element, of a surface area covered with dots formed by an i-th image-recording element under ideal conditions, Si+ is a total surface area of a portion contained in the rectangular area of (Np/2)×Ds on the side of the (i+1)-th image-recording element, of a surface area covered with dots formed by an image-recording element other than the i-th element under ideal conditions, and α is a predetermined constant.

6. The image recording method as defined in claim 5, wherein the predetermined constant α is 0.4, and Ds is not shorter than 1 mm and not longer than 10 mm.

7. The image recording method as defined in claim 5, wherein:

the recording head is a high-density recording head in which the array pitch Np of the image-recording elements in the main scanning direction is not longer than 30 μm; and the solid portion is not smaller than a 5 mm square on the printing medium.

8. The image recording method as defined in claim 5, wherein:

the image-recording elements comprise nozzles which discharge ink droplets; and the recording control includes controlling droplet ejection from the nozzles so as to make the diameter of the dots produced by the ink droplets ejected from the nozzles greater than the array pitch of the nozzles in the main scanning direction.

* * * * *